US008875592B2

(12) United States Patent
Bastholm et al.

(10) Patent No.: US 8,875,592 B2
(45) Date of Patent: Nov. 4, 2014

(54) LINEAR ACTUATOR

(75) Inventors: Jeppe Christian Bastholm, Sønderborg (DK); John Guttorm Abrahamsen, Nordborg (DK)

(73) Assignee: Linak A/S, Nordborg (DK)

( * ) Notice: Subject to any disclaimer, the term of this patent is extended or adjusted under 35 U.S.C. 154(b) by 158 days.

(21) Appl. No.: 13/513,476

(22) PCT Filed: Dec. 6, 2010

(86) PCT No.: PCT/DK2010/000166

§ 371 (c)(1), (2), (4) Date: Jun. 1, 2012

(87) PCT Pub. No.: WO2011/066836

PCT Pub. Date: Jun. 9, 2011

(65) Prior Publication Data

US 2012/0240696 A1 Sep. 27, 2012

(30) Foreign Application Priority Data

Dec. 4, 2009 (DK) ..... 2009 01282

(51) Int. Cl.

| | |
|---|---|
| ***F16H 3/06*** | (2006.01) |
| ***F16H 27/02*** | (2006.01) |
| ***F16H 29/02*** | (2006.01) |
| ***F16H 29/20*** | (2006.01) |
| ***A47C 20/04*** | (2006.01) |

(52) U.S. Cl.

CPC ..... *A47C 20/042* (2013.01); *A47C 20/041* (2013.01)

USPC ..... 74/89.39; 74/89.38

(58) Field of Classification Search

USPC ..... 74/89.23, 89.38, 89.39; 188/184, 185; 192/140, 141, 144

See application file for complete search history.

(56) References Cited

U.S. PATENT DOCUMENTS

| | | | | |
|---|---|---|---|---|
| 1,674,234 | A * | 6/1928 | Jakob | 192/144 |
| 4,000,881 | A * | 1/1977 | Matsumoto | 182/241 |

(Continued)

FOREIGN PATENT DOCUMENTS

| | | |
|---|---|---|
| DE | 3842078 | 7/1989 |
| DE | 29612493 | 10/1996 |

(Continued)

OTHER PUBLICATIONS

English Abstract of DE 3842078.

*Primary Examiner* — Justin Krause

(74) *Attorney, Agent, or Firm* — Dykema Gossett PLLC

(57) ABSTRACT

A linear actuator with a reversible electric motor (3,11,26,27,34), which over a transmission (4,12,24,25,35) drives a non-self locking spindle (5,14,22,23,36), by which a tube-shaped positioning element can be moved axially, in that it with one end is connected to a spindle nut (6,15) on a spindle (5,14,22,23,36). The actuator comprises a quick release (9,13) for releasing the tube-shaped positioning element (7,16,28,29,37) from the electric motor (3,11,26,27,34) and the part of the transmission (4,12,24,25,35) that lies from the motor (3,11,26,27,34) to the quick release (9,13) such that the spindle (5,14,22,23,36) is set to rotate by the load on the tube-shaped positioning element (7,16,28,29,37). The actuator further comprises braking means for controlling the speed of the tube-shaped positioning element (7,16,28,29,37) during the outer load, when the quick release (9,13) is activated. The braking means consists of a centrifugal brake (38,60), by which it is possible to provide a construction where the lowering speed is self-controlled when the quick release (9,13) is activated.

4 Claims, 6 Drawing Sheets

(56) References Cited

U.S. PATENT DOCUMENTS

| | | | | |
|---|---|---|---|---|
| 5,075,911 | A | 12/1991 | Dewert | |
| 5,161,274 | A | 11/1992 | Hayes et al. | |
| 5,329,657 | A * | 7/1994 | Bartley et al. | 5/617 |
| 5,346,045 | A * | 9/1994 | Bennett et al. | 192/141 |
| 5,927,144 | A | 7/1999 | Koch | |
| 6,158,295 | A | 12/2000 | Nielsen | |
| 6,240,797 | B1 | 6/2001 | Morishima et al. | |
| 7,047,834 | B2 | 5/2006 | Nielsen et al. | |
| 7,533,591 | B2 | 5/2009 | Wang | |
| 8,181,546 | B2 | 5/2012 | Larsen et al. | |
| 8,193,755 | B2 * | 6/2012 | Jensen et al. | 318/687 |
| 8,308,603 | B2 | 11/2012 | Knudsen et al. | |
| 2009/0100951 | A1 | 4/2009 | Frost | |

FOREIGN PATENT DOCUMENTS

| | | |
|---|---|---|
| EP | 0577541 | 1/1994 |
| EP | 0685662 | 12/1995 |
| WO | 2004071243 | 8/2004 |

* cited by examiner

LINEAR ACTUATOR

BACKGROUND OF THE INVENTION

1. Field of the Invention

The present invention relates to a linear actuator.

2. The Prior Art

In beds for hospital and care the surface for carrying the mattress is divided in a back rest section and leg rest section and also typically an intermediate section. The sections for the back and leg can be individually adjusted about a horizontal axis each by means of a linear actuator, cf . e.g., EP 0 498 111 A2 J. Nesbit Evans & Company Ltd.

In certain situations, e.g., in the case of a heart failure, it is crucial momentary to be able to lower the back rest section from an upright position to a horizontal position without the motor and transmission of the linear actuator. For this purpose it is known to equip linear actuators of the "single actuator type" with a quick release, which releases the spindle of the actuator from the motor and at least a part of the transmission. Examples of linear actuators of this type is known from EP 0 577 541 A1, EP 0 685 662 A2, WO 03/033946 A1 and WO 2006/039931 A1 all Linak A/S. It is noticed that the spindle of the actuator is non self-locking, whereby the load on the tube-shaped positioning element which is connected to the spindle nut, starts the rotation of the spindle. The spindle will due to the load accelerate, whereby the positioning element will move towards the end position with increasing speed and the back rest section will in a collision-like manner brake instantly when the back rest section reaches its horizontal position. This is injurious for the patient, who is already traumatized and further it is a severe overload of the bed construction and the linear actuator.

Since the situation by and large is chaotic around the patient, there is in addition a considerable risk that somebody gets caught between the back rest section and the upper frame in which the back rest section is embedded, when it speeds uncontrollably to a horizontal position. This problem has previously been acknowledged in EP 0 944 788 B1 Linak A/S, relating to a linear actuator with a quick release and braking means for controlling the speed of the spindle, when it is released from the motor and transmission. The specific embodiment in EP 0 944 788 B1 deals with a coil spring functioning as a brake spring which tightens against a stationary contact surface. By a controlled loosening of the contact of the coil spring with the contact surface the velocity of the spindle can be controlled. The construction is as far as it goes fine, however delicacy of the operator is required in order to control the speed evenly. In addition the construction is quite complicated. From EP 1 592 325 B1 Dewert Antriebs- and Systemtechnik GmbH a construction is known, where there on the outer end of the tube-shaped positioning element and a fork-shaped front mounting is mounted a worm gear, which drives a cone-shaped element connected to a stationary corresponding cone-shaped braking element. The cone-shaped braking element is spring-loaded in its engagement with the cone-shaped element, which is driven by the worm gear. With an operating handle the cone-shaped braking element can be pulled out of its engagement with the cone-shaped element on the worm gear, whereby the tube-shaped positioning element will start to rotate, causing the spindle nut to start rotating inwards on the spindle. By pulling the cone-shaped braking element more or less out of its engagement with the cone-shaped element on the worm gear, the lowering speed of the tube-shaped positioning element can be controlled.

It is noticed that actuators without a tube-shaped positioning element are also known, but where the spindle nut is embodied as a positioning element and at which the actuator is fastened in the construction, wherein this is built in. An example of such an actuator is known from WO 96/12123 Dietmar Koch. These types of actuators are typically used in armchairs or recliners.

For beds for domestic use a motor drive was developed at the end of the 1980s, where a linear actuator was built into each end of a mutual housing. The motor drive is mounted on the pivot shafts for the back rest section and leg rest section of the bed. These pivot shafts are provided with an arm extending into the housing where it rests against the spindle nut, which is embodied as a sliding element. These dual linear actuators have been developed further such that they also can be used for care beds. Such a dual linear actuator is for example known from WO 89/10715 Eckhart Dewert and DE 38 42 078 A1 Niko Gesellschaft far Antriebstechnik mbH and also WO 2007/112745 A1 Linak A/S. An example of such an actuator with a quick release is dealt with in DE 296 12 493 U1 Dewert Antriebs- and Systemtechnik GmbH Co.

SUMMARY OF THE INVENTION

The purpose of the invention is to provide another solution for a controlled lowering or retraction of the tube-shaped positioning element, when it is released from the motor and transmission.

According to the invention the linear actuator is characteristic in that, the braking means are constituted by a centrifugal brake connected to the spindle when the quick release is activated, alternatively that the braking means are constituted by a centrifugal brake connected to the tube-shaped positioning element when the quick release is activated. Hereby it is possible to provide a construction, where the lowering speed is self-controlled when the quick release is activated. In other words it is not necessary to rely on the operator's ability to control the speed. In principle, the quick release could also be locked in its activated position so that the operator could do something else in the acute situation for the patient. When the back rest section reaches its horizontal position, it could be arranged so that the operation of the quick release was released automatically so that the spindle/the tube-shaped positioning element was coupled again and the actuator is ready for normal operation.

To obtain an improved effect of the centrifugal brake a gear for increasing the rotation of the centrifugal brake is in a further development located in the connection between the centrifugal brake and the spindle or the tube-shaped positioning element. Expediently, it is embodied so that the gear is coupled when the quick release is activated.

In a particular compact embodiment, the drive is constituted by a planetary gear and the transmission by a worm gear, where the worm wheel is constituted by the toothed rim of the planetary gear. The spindle is connected to the planetary wheel holder and the sun wheel to the centrifugal brake and also the quick release so that the sun wheel is held during normal operation.

BRIEF DESCRIPTION OF THE DRAWINGS

A linear actuator according to the invention will be described more fully below with reference to the accompanying drawings.

DETAILED DESCRIPTION OF THE PREFERRED EMBODIMENTS

Figures 1, 2, 13:
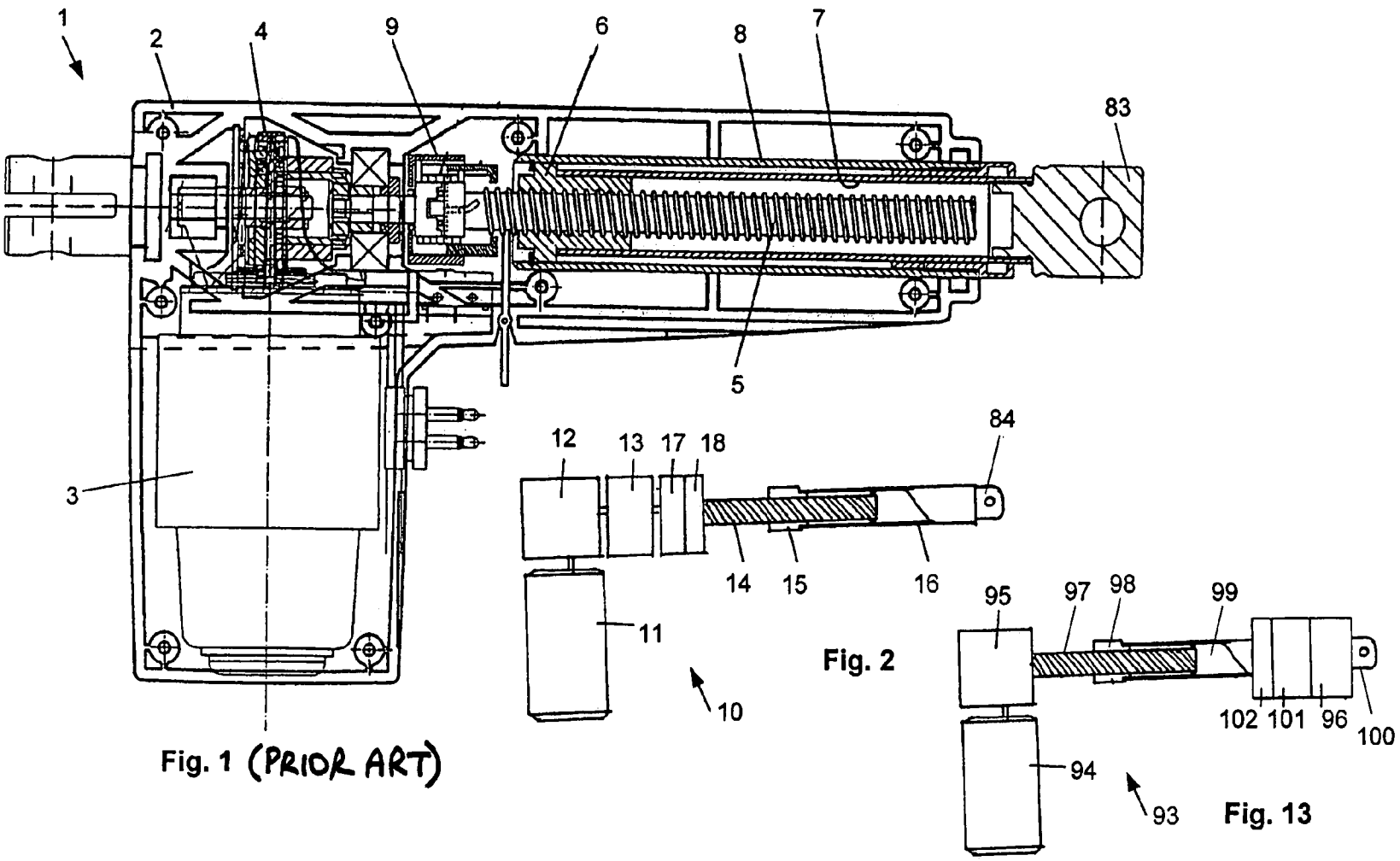
Fig. 1 (PRIOR ART)
FIG. 1 shows a known linear actuator comprising a quick release.
FIG. 2 shows a schematic construction of the actuator according to the invention.
FIG. 13 shows a schematic construction of an actuator according to the invention.

As appears from FIG. 1, the main components of an actuator 1, are a housing 2 with a reversible electric motor 3, which over a worm gear 4 drives a spindle 5 with a spindle nut 6, to which a tube-shaped positioning element 7 is fastened also called an inner tube surrounded by an outer tube 8. At the end of the tube-shaped positioning element 7 a mounting bracket 83 for mounting of the actuator 1 is placed. The actuator 1 in question is provided with a quick release 9 and is moreover dealt with in EP 0 685 662 B1 Linak A/S and to which reference is made. An alternative embodiment of a quick release for a linear actuator is furthermore dealt with in WO2006/039931 A1 Linak A/S.

FIG. 2 of the drawing schematically shows a linear actuator 10 according to the invention, comprising a reversible low voltage DC-motor 11, a transmission 12, a quick release 13, a spindle 14 with a spindle nut 15 and a tube-shaped positioning element (inner tube) 16. At the end of the tube-shaped positioning element 16 a mounting bracket 84 for mounting the actuator 10 is placed. The spindle 14 is via a gearing 17 connected to a centrifugal brake 18. The gearing 17 is for gearing up the rotational speed of the spindle for the centrifugal brake 18. The gearing 17 can be a simple toothed gearing or a more complex gear such as a planetary gear.

Figure 3:
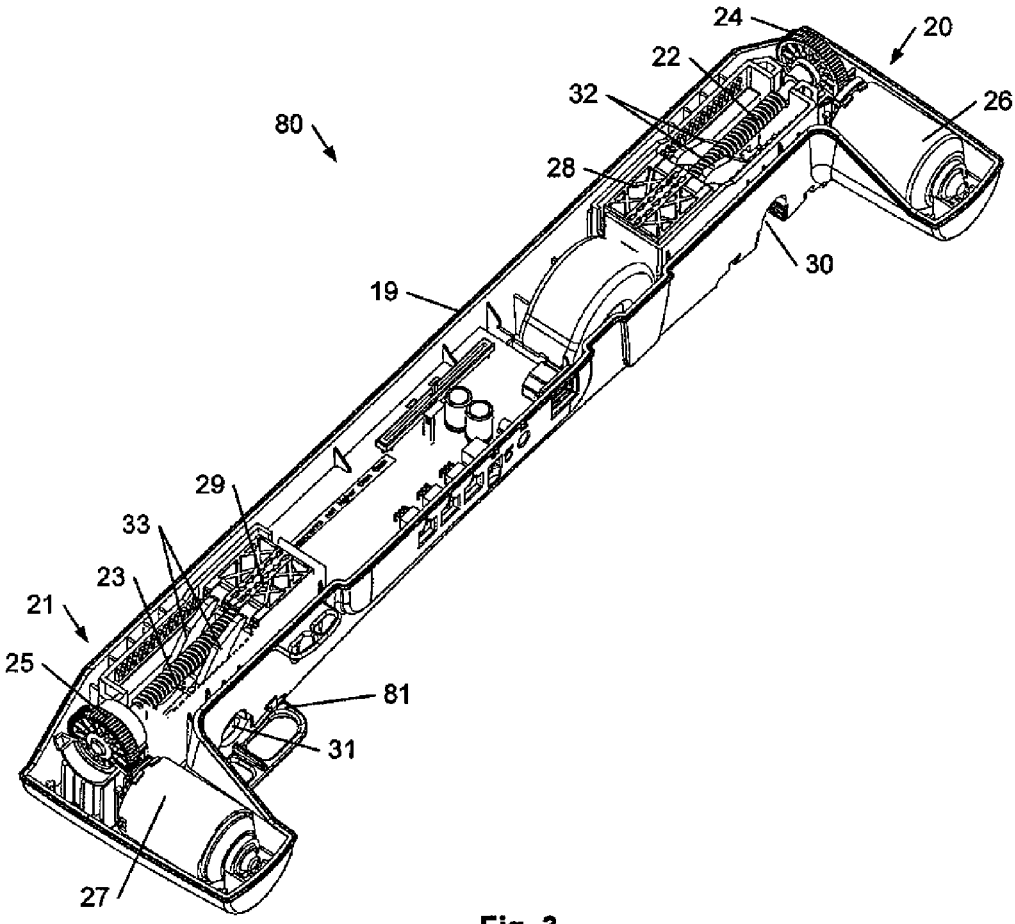
FIG. 3 shows in perspective a view into a dual actuator where the bottom cover has been removed.

In FIG. 3 a dual actuator 80, shown open, for care beds or home beds is shown. The dual actuator 80 comprises a mutual housing 19 with a linear actuator 20,21 in each end. The housing 19 is constituted by two parts, where the upper part appears as a housing and the lower part appears as a bottom cover, which is not shown. The actuator 20,21 comprises a spindle 22,23 which over a transmission 24,25 is driven by a reversible low voltage DC-motor 26,27. On the spindle 22,23 a spindle nut configured as a block-shaped positioning element 28,29 is guided in the housing 19. At the upper side of the housing 19 there is a transverse recess 30,31 for pivot shafts of the back rest and leg rest sections, respectively. Access thereto takes place via a sideways displaceable cover 81 which is only shown attached in one end. On the pivot shafts there is an arm 32,33, here configured as a claw, that grips down on each side of the spindle 22,23 and which abuts one end of the positioning element 28,29. This construction is by and large known cf. for example WO 2007/112745 Linak A/S.

Figure 4:
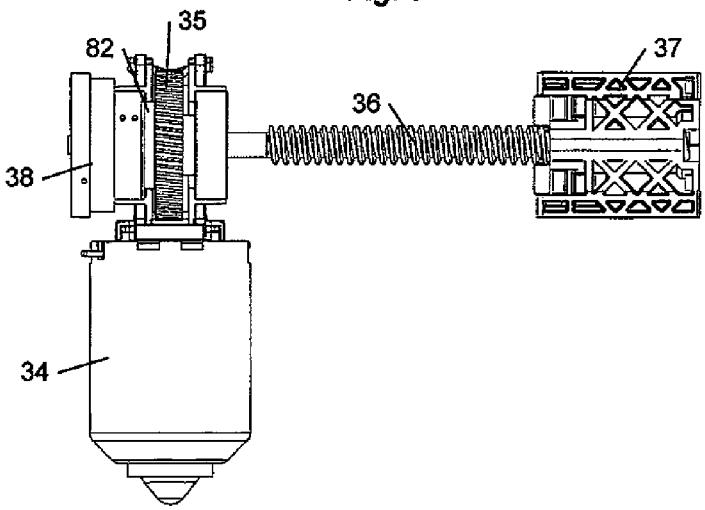
FIG. 4 shows the construction of the actuator according to the invention for a dual actuator.

In FIG. 4 a linear actuator 20,21 according to the invention for this type of dual actuators 80 in FIG. 3 is shown. This linear actuator 20,21 is built as disclosed earlier with a reversible low voltage DC-motor 34, a transmission 35, a spindle 36 with a spindle nut configured as a positioning element 37. A quick release 82 which can release the transmission 35 from the spindle 36 is located in connection with the transmission 35. The spindle 36 is connected to a centrifugal brake unit 38 comprising a gear (not referred) for gearing up the rotational speed of the spindle 36 for the centrifugal brake unit 38. The gear can be a simple toothed gear or a more complex gear such as a planetary gear.

Figure 5:
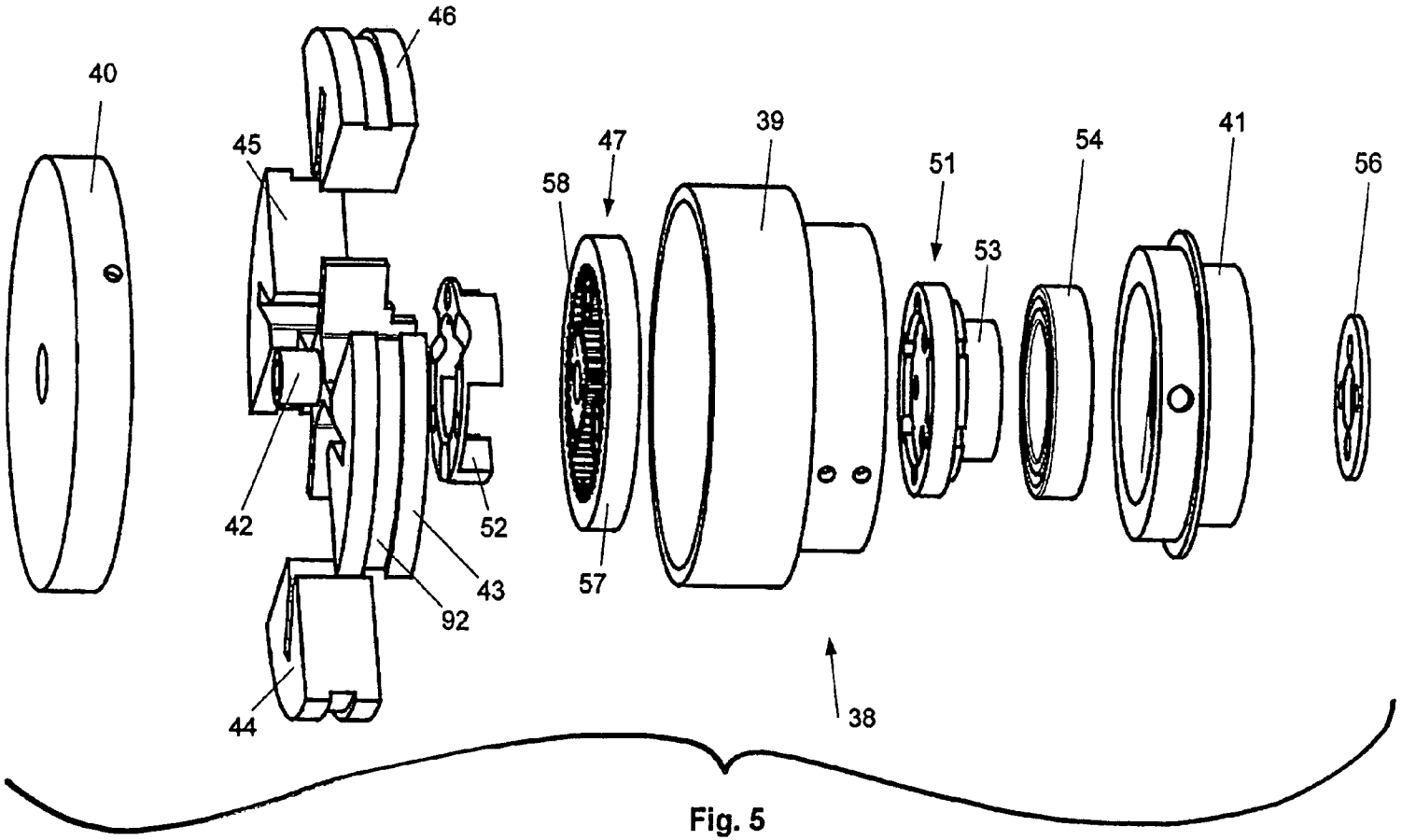
FIG. 5 shows an exploded view of the centrifugal brake unit.

In FIG. 5 an embodiment of the centrifugal brake unit 38 in FIG. 4 is shown in an exploded perspective view. The exterior of the centrifugal brake unit 38 comprises a cylindrical house 39, a bottom piece 40 and a front piece 41. A part of the cylindrical house 39 is used as a drum for the rotating parts of the centrifugal brake, that is a rotor 42 and brake blocks 43,44,45,46. Another part of the cylindrical house 39 is used to house a planetary gearing 47 (see FIG. 7 for a detailed description). One end of the axles (not shown) of the planetary wheel 48,49,50 (see FIG. 7) of the planetary gear 47 is fastened to an axle housing 51, and the other end of the axles fastened to an end piece 52. The axle housing 51 comprises a boss 53, on which the inner bearing bush of the bearing 54 is fastened. The outer bearing bush of the bearing 54 is fastened to the inner side of the front piece 41, for instance by a forced fit. The end surface 55 of the axle housing 51 is via a washer 56 fastened to the spindle of the actuator. The planetary gear 47 comprises a toothed rim 57 with internal teeth, which is fastened to the inner side of the cylindrical house 39.

The sun wheel 58 is connected to the rotor 42 through an axle (not shown), which at the rotor end is secured in a hole (not referred) in the bottom piece 40. The centrifugal brake unit 38 can by activation of the quick release of the actuator 20,21 brake the rotational speed of the spindle 22,23,36 of the actuator. This takes place in the following manner. By activation of the quick release the spindle is released from the transmission 24,25,35. Due to the load on the positioning element (spindle nut) 28,29,37 the spindle 22,23,36 will start to rotate, whereby the positioning element (spindle nut) 28,29,37 starts moving towards the transmission 24,25,35. The rotation of the spindle 22,23,36 is transferred directly to a rotation of the planetary wheels 48,49,50, which via the sun wheel 57 causes a rotation of the rotor 42. Due to the gearing of the planetary gear 47 the rotational speed of the sun wheel 57 will be higher than the spindle 22,23,36. The brake blocks 43,44,45,46 will be carried along by the rotor and will as the rotational speed increases be displaced in a radially outwards direction as a result of the influence of the centrifugal force. When the outer side of the brake blocks 43,44,45,46 strikes the inner side of the house 39, friction develops in the contact surface, whereby the rotor 42 and accordingly the rotation of the spindle 22,23,36 is braked. The centrifugal force on the brake blocks 43,44,45,46 is increased concurrently with the increased rotational speed of spindle 22,23,36, whereby the friction in the contact surface between the brake blocks 43,44,45,46 and the inner side of the house 39 is increased accordingly. It is understood that the rotation of the spindle terminates when the positioning element 28,29,37 reaches its end stop.

From the maximal load on the actuator one can determine the maximal brake effect that the centrifugal force can brake with and thereby determine a maximal lowering speed. One must recall that the brake under no circumstances is allowed to block the lowering of the tube-shaped positioning element of the actuator. This blocking can be eliminated by arranging a rubber ring (not shown) in a recess 92 (for the sake of clarity only the recess on the brake block 43 is referenced) on the outer side of each brake block. The rubber ring secures as a rule the brake blocks 43,44,45,46 to the rotor 42. The rubber ring causes that the centrifugal force exerted on the brake blocks 43,44,45,46 must have a certain magnitude before a braking effect is obtained. In an alternative embodiment each sliding connection between the rotor 42 and the brake blocks 43,44,45,46 could comprise a spring.

Figure 6:
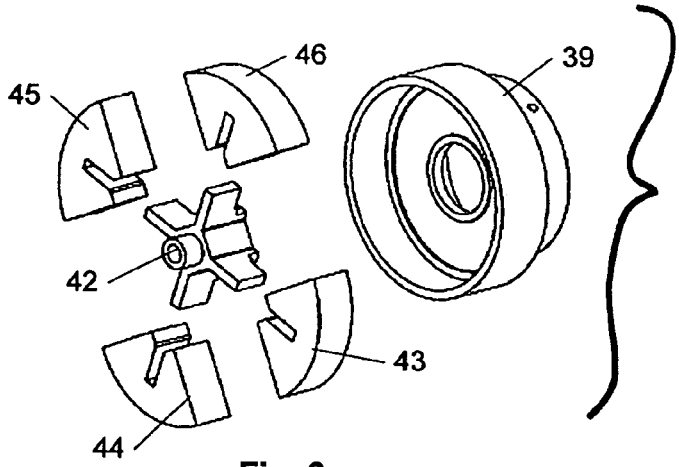
FIG. 6 shows the rotation parts of the centrifugal brake of the unit in FIG. 5.

In FIG. 6 is shown all the rotating parts of the centrifugal brake of the unit in FIG. 5, comprising a rotor 42, brake blocks 43,44,45,46, and a cylindrical house 39. The rotor 42 comprises four arms in which each of the brake blocks 43,44,45,46 can slide. The characteristic and number of brake blocks and thereby also the configuration of the rotor can be varied and adapted such that the desired braking effect can be obtained.

Figure 7:
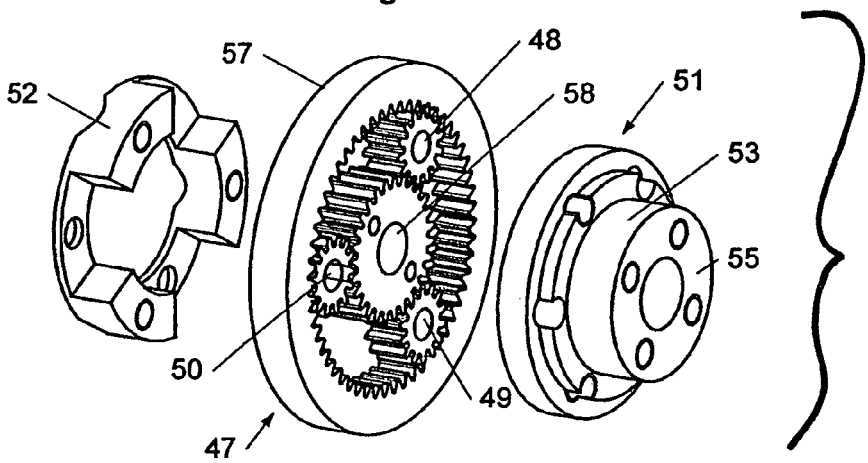
FIG. 7 shows the planetary gear of the centrifugal brake unit in FIG. 5, FIGS. 8-11 show an alternative embodiment of a centrifugal brake.

FIG. 7 shows the planetary gear 47 of the centrifugal brake unit 38 in FIG. 5. The planet gear comprises a toothed rim 57, three planetary wheels 48,49,50 and a sun wheel 58. As described in connection with FIG. 5 the planetary gear comprises an axle housing 51 and an end piece 52.

It is realized that the centrifugal brake can be coupled permanently such that it is brought along during the normal operation of the actuator. On the other hand this is not appropriate in terms of energy, as it requires a certain, though small amount of energy to keep the brake in motion although the speed in itself is not sufficient to activate the braking elements. It is therefore expedient not to couple the centrifugal brake before the quick release is activated.

Figure 8:
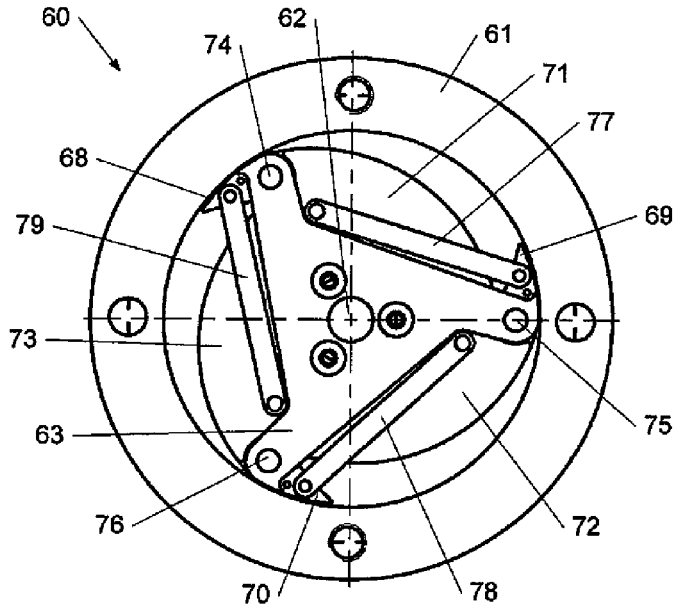
Figure 9:
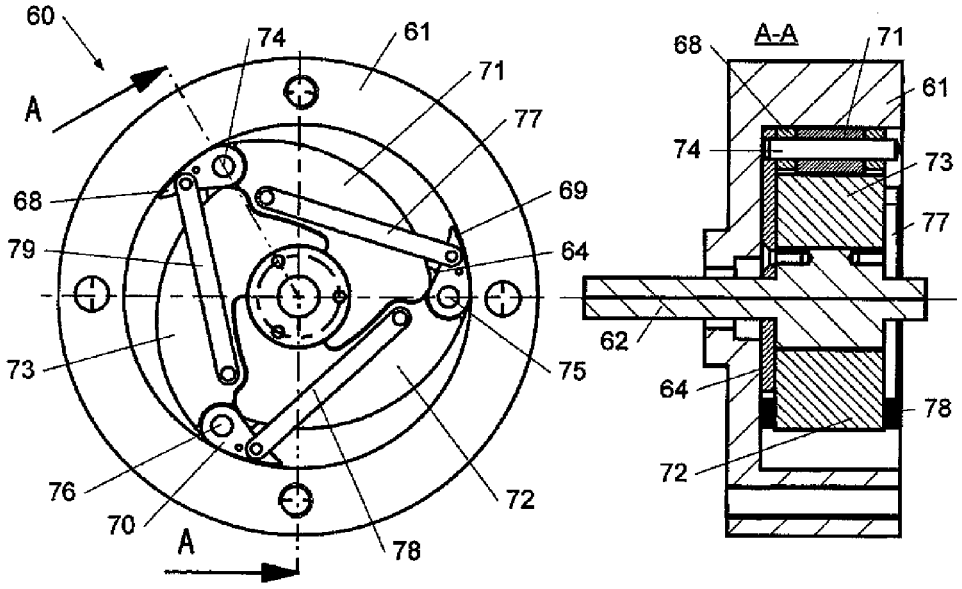
Figure 10:
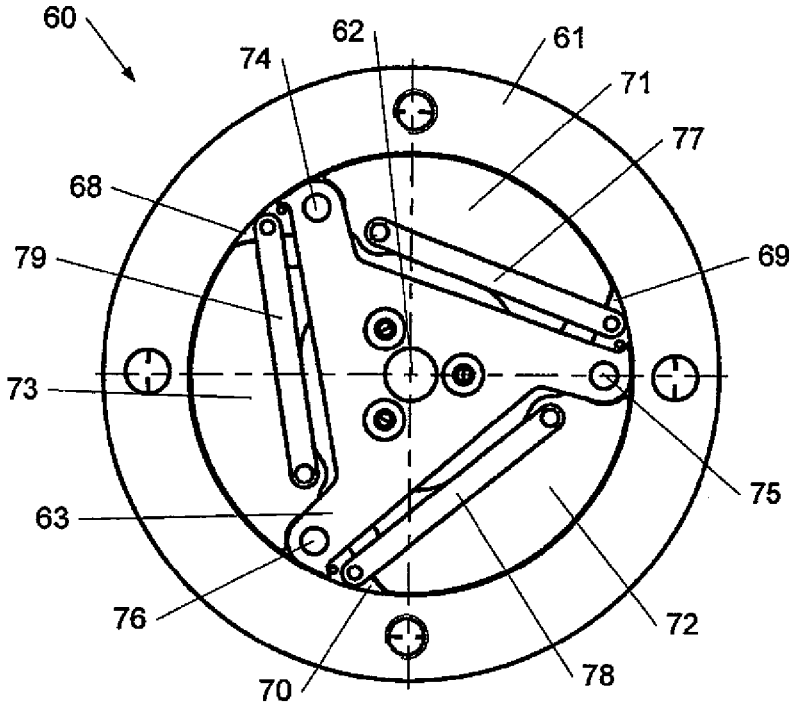
Figure 11:
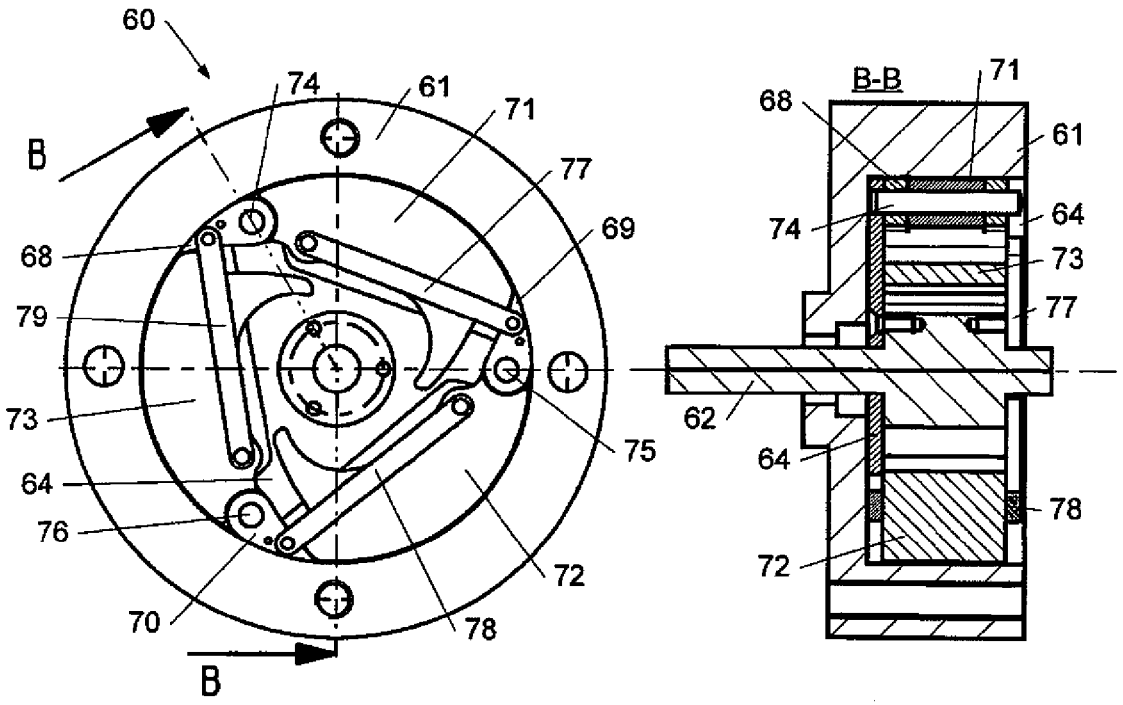

FIG. 8 shows an alternative embodiment of a centrifugal brake 60, comprising a stationary housing 61, housing a bearing wherein a rotor 62 is placed, which is coupled to the spindle of the actuator. Two identical 3-branched drive plates 63,64 are fastened to each side of a boss of the rotor 62, such that centre axis of the drive plates 63,64 is convergent with the rotational axis of the rotor 62. It is noticed that the view in FIGS. 8,9,10 and 11 is the same, but that the drive plate 63 is removed in FIGS. 9 and 10. Since the drive plate 63 shadows for the drive plate 64 in FIGS. 8 and 10, the drive plate 64 can therefore best be seen in FIG. 11. Since the two drive plates 63,64 are identical, only the drive plate 63 is referenced, but the technical characteristics thereof are the same for the drive plate 64. Between each of the arms 65,66,67 on the two drive plates 63,64 and approximately at the end of these a brake lever 68,69,70 and a flyweight 71,72,73 are by means of a pin 74,75,76 hinged in pairs. The pins 74,75,76 are fastened to the two drive plates 63,64 in a hole. The brake levers 68,69,70 and the flyweights 71,72,73 hinged in pairs are further on each side connected with the connecting rods 77,78,79. One end of the connecting rods 77,78,79 are hinged to the brake levers 68,69,70 and the other end is hinged to the flyweights 71,72,73. Notice that the connecting rods on the same side as the drive plate 64 is not shown.

When the quick release is not activated a rubber element (not shown) mounted on the brake levers 68,69,70 between the drive plates 63,64 and the connecting rods 77,78,79 ensures that the flyweights are held against the boss of the rotor 62.

When the quick release is activated and the spindle is released from the motor and transmission, the load on the tube-shaped positioning element will set the spindle into rotation and thereby the rotor of the centrifugal brake 62 will be set in rotation. The flyweights 71,72,73 are then thrown against the inner side of the house of the brake and a braking is initiated, see FIGS. 10 and 11. As the speed of the spindle increases, the flyweights 71,72,73 are thrown with greater centrifugal force against the sidewall in the house of the brake 61 and the braking becomes more powerful as a result of the friction in the contact surfaces. During rotation the connection rods 77,78,79 function as a an angle lever arm, that contributes to reinforce this friction. The reinforced braking effects obtained with the connection rods 77,78,79 results in that this centrifugal brake does not have to be coupled to the spindle via a gearing.

Figure 12:
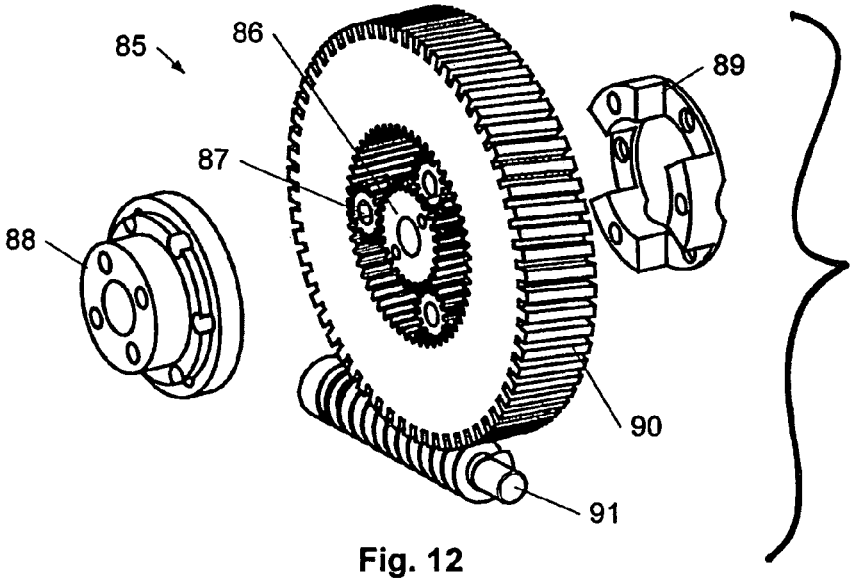
FIG. 12 shows an alternative embodiment of an planetary gear.

Referring to FIG. 12, which is a principle sketch of a planetary gear 85, comprising a sun wheel 86, planetary wheel 87, a planetary wheel holder 88,89 and an outer toothed rim 90 with internal teeth. The transmission of the actuator is constituted by a worm gear, where the worm 91 is constituted by an extension of the drive shaft of the motor. The worm wheel of the worm gear is constituted by the toothed rim 90 of the planet gear 85, which has an outer worm wheel toothing. The spindle (not shown) is with a shaft end connected to the planet wheel holder 88,89. The sun wheel 86 is connected to the centrifugal brake and also to the quick release, such that the sun wheel 86 is held during normal operation. During normal operation the motor drives the toothed rim 90 via the worm 91, whereby the planetary wheel holder 88,89 is set in rotation via the planetary wheels 87 and thus the spindle rotates. Concurrently, the sun wheel 86 is held by the quick release. By activation of the quick release the sun wheel 86 is released. The load on the spindle will then drive the planet wheel holder 88,89 and thus the planetary wheels 87 around. Since the worm gear is self-locking the toothed rim 90 will stand still and the planetary wheels 87 will then rotate the sun wheel 86. The sun wheel 86 drives the centrifugal brake and thereby the speed of the spindle is decelerated. With a gearing (gearing up) at 1:3 in the planetary gear, the rotor of the centrifugal brake is driven around with a relatively high velocity compared to the spindle and thus a good braking effect is obtained. During normal operation the planetary gear 85 has a reduction at 1,5.

In FIG. 13 of the drawing is schematically shown a linear actuator 93 according to the invention, which consists of reversible low voltage DC-motor 94, a transmission 95, a spindle 97 with a spindle nut 98 and a tube-shaped positioning element (inner tube) 99. A fitting 100 for mounting of the actuator 93 is placed at the outer end of the tube-shaped positioning element 99. A quick release 96 connected to centrifugal brake 102 via a gear 101 is placed between the fitting 100 and the tube-shaped positioning element 99. During normal operation of the actuator 93 the fitting 100 will be fixed relative to the tube-shaped positioning element 99. By activation of the quick release 96 the tube-shaped positioning element 99 is released from the fitting 100, whereby the tube-shaped positioning element 99 can rotate freely relative to the fitting, for example via a bearing connection (not shown). A compressive load on the fitting 100 will then be transferred to the tube-shaped positioning element 99 and cause this to rotate in an inwards direction. It is noticed that the spindle 97 of the actuator is fixed during rotation by the tube-shaped positioning element 99. Rotation of the tube-shaped positioning element 99 is braked by the centrifugal brake 102, which is coupled hereto. This braking effect can be increased by coupling the centrifugal brake 102 to a gear 101, which for example can be a planetary gear of the type mentioned elsewhere in the present application. Hereby the rotational speed of the tube-shaped positioning element 99 can be controlled. Hence the tube-shaped positioning element 99 can be moved in an inwards direction at a desired velocity.

The invention claimed is:

1. A linear actuator which comprises:

a non-self-locking spindle, a spindle nut mounted on the spindle to move axially along the spindle with rotation of the spindle, a non-rotating tube-shaped positioning element associated with the spindle nut to move axially along the spindle with the spindle nut, a reversible electric motor for rotating the spindle, said electric motor including a shaft with a worm, a quick release mechanism for disconnecting the spindle from the electric motor when the quick release mechanism is activated, and braking means for controlling a speed of movement of the positioning element along the spindle under an external load after the quick release mechanism has been activated, said braking means including a centrifugal brake connected to the spindle and a gearing mechanism between the centrifugal brake and the spindle for increasing revolutions of the centrifugal brake, said gearing mechanism comprising a planetary gear comprising a sun wheel, a planetary wheel holder and an outer toothed rim with outer worm wheel toothing to which the worm is engaged, the spindle being connected to the planetary wheel holder and the sun wheel is connected to the centrifugal brake and the quick release mechanism.

2. The linear actuator according to claim 1, wherein the centrifugal brake includes a stationary drum with an inner wall defining a cylindrical cavity and a braking surface, a rotor, a drive plate fastened to the rotor, a flyweight arranged in the cylindrical cavity of the stationary drum and which is swivel hinged to the drive plate, a brake lever which together with the flyweight is hinged to the drive plate, a connection rod which with one end is pivotally connected to the brake lever to which the flyweight is not hinged, such that interaction between brake lever, connection rod and flyweight increases pressing of the flyweight and the brake lever against the wall of the cavity of the stationary drum, when the flyweight and the brake lever are thrown against the wall.

3. The linear actuator according to claim 2, wherein a flyweight and a brake lever are hinged to the drive plate at the wall of the cylindrical cavity of the stationary drum.

4. The linear actuator according to claim 2, including three flyweights and three brake levers and also three connection rods, and where an outer side of the flyweights in a thrown position against the wall in the cylindrical cavity of the stationary drum together with the outer side of the brake levers essentially covers a whole circumference of the wall.

* * * * *